US010378833B2

(12) United States Patent
Higashiiue et al.

(10) Patent No.: US 10,378,833 B2
(45) Date of Patent: Aug. 13, 2019

(54) STACKING-TYPE HEADER, HEAT EXCHANGER, AND AIR-CONDITIONING APPARATUS

(71) Applicant: Mitsubishi Electric Corporation, Tokyo (JP)

(72) Inventors: Shinya Higashiiue, Tokyo (JP); Shigeyoshi Matsui, Tokyo (JP); Takehiro Hayashi, Tokyo (JP); Norihiro Yoneda, Tokyo (JP); Atsushi Mochizuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 164 days.

(21) Appl. No.: 15/554,482

(22) PCT Filed: Apr. 27, 2016

(86) PCT No.: PCT/JP2016/063220
§ 371 (c)(1),
(2) Date: Aug. 30, 2017

(87) PCT Pub. No.: WO2016/176398
PCT Pub. Date: Nov. 10, 2016

(65) Prior Publication Data

US 2018/0073820 A1 Mar. 15, 2018

(30) Foreign Application Priority Data

May 1, 2015 (WO) ..... PCT/JP2015/063131

(51) Int. Cl.
*F24F 1/00* (2019.01)
*F28D 1/04* (2006.01)
(Continued)

(52) U.S. Cl.
CPC ..... *F28F 9/0278* (2013.01); *F24F 1/00* (2013.01); *F25B 41/00* (2013.01); *F28D 1/0435* (2013.01);
(Continued)

(58) Field of Classification Search
CPC .... F28F 9/0278; F28F 9/0221; F28F 2275/04; F28F 9/0224; F24F 1/00; F25B 41/00;
(Continued)

(56) References Cited

U.S. PATENT DOCUMENTS 4,903,389 A * 2/1990 Wolf ..... F28F 9/001 165/153
4,917,180 A * 4/1990 Wolf ..... F28D 1/05375 165/150
(Continued)

FOREIGN PATENT DOCUMENTS

JP 09-113156 A 5/1997
JP 09-189463 A 7/1997
(Continued)

OTHER PUBLICATIONS

International Search Report of the International Searching Authority dated Jul. 19, 2016 for the corresponding International application No. PCT/JP2016/063220 (and English translation).

*Primary Examiner* — Justin M Jonaitis
(74) *Attorney, Agent, or Firm* — Posz Law Group, PLC

(57) ABSTRACT

A stacking-type header according to the present invention includes a plurality of first plates and a plurality of second plates stacked on one another and brazed together such that each of the plurality of second plates is disposed between adjoining two of the plurality of first plates. The plurality of first plates include a first end plate that is an outermost one of the plurality of first plates in a stacking direction of the plurality of first plates and that has a first through hole, and
(Continued)

a second end plate that is another outermost one of the plurality of first plates in the stacking direction of the plurality of first plates and that has a plurality of second through holes. The plurality of first plates and the plurality of second plates have a communication hole that connects the first through hole of the first end plate and the plurality of second through holes of the second end plate. The plurality of second plates each have at least one opening formed at other than the communication hole. The opening communicates with atmosphere.

11 Claims, 10 Drawing Sheets

(51) Int. Cl.
*F28F 9/02* (2006.01)
*F25B 41/00* (2006.01)
*F28D 1/053* (2006.01)

(52) U.S. Cl.
CPC ..... *F28D 1/05375* (2013.01); *F28F 9/0221* (2013.01); *F28F 2275/04* (2013.01)

(58) Field of Classification Search
CPC .. F28D 1/0435; F28D 1/05375; F28D 1/0476; F28D 1/05366; F28D 1/05383; F28D 2021/0068; B21D 53/08
USPC ..... 165/151, 174
See application file for complete search history.

(56) References Cited

U.S. PATENT DOCUMENTS

| | | | | |
|---|---|---|---|---|
| 5,241,839 | A * | 9/1993 | Hughes | B60H 1/3227 165/174 |
| 5,242,016 | A * | 9/1993 | Voss | F25B 39/028 165/173 |
| 5,836,383 | A | 11/1998 | Zwittig | |
| 10,054,368 | B2 * | 8/2018 | Nishiyama | F28F 9/0221 |
| 2004/0159121 | A1 * | 8/2004 | Horiuchi | F25B 39/02 62/526 |
| 2005/0039901 | A1 * | 2/2005 | Demuth | F28D 1/0478 165/175 |
| 2016/0076823 | A1 * | 3/2016 | Okazaki | F28F 9/028 165/174 |
| 2016/0076825 | A1 * | 3/2016 | Matsuda | F28F 9/0278 165/148 |
| 2016/0195335 | A1 | 7/2016 | Nishiyama et al. | |

FOREIGN PATENT DOCUMENTS

| | | | |
|---|---|---|---|
| JP | 11-118295 | A | 4/1999 |
| JP | 2000-220914 | A | 8/2000 |
| JP | 2006-010174 | A | 1/2006 |
| WO | 2015/004719 | A1 | 1/2015 |

* cited by examiner

STACKING-TYPE HEADER, HEAT EXCHANGER, AND AIR-CONDITIONING APPARATUS

CROSS REFERENCE TO RELATED APPLICATION

This application is a U.S. national stage application of PCT/JP2016/063220 filed on Apr. 27, 2016, which claims priority to International Patent Application No. PCT/JP2015/063131 filed on May 1, 2015, the contents of which are incorporated herein by reference.

TECHNICAL FIELD

The present invention relates to a stacking-type header, a heat exchanger, and an air-conditioning apparatus.

BACKGROUND

A stacking-type header is known in the art that distributes and supplies refrigerant to heat transfer tubes of a heat exchanger. This stacking-type header includes a plurality of plates stacked on one another to form distribution passages extending from one inlet passage to a plurality of outlet passages. Such a configuration allows the refrigerant to be distributed and supplied to the heat transfer tubes, serving as the distribution passages, of the heat exchanger (see Patent Literature 1, for example).

PATENT LITERATURE

Patent Literature 1: Japanese Unexamined Patent Application Publication No. 9-189463

The stacking-type header is configured in such a manner that the plates included in the stacking-type header are joined by brazing. The brazing process involves heating a brazing material, serving as dad layers, on the surfaces of the plates to melt the brazing material and forming fillets on side surfaces of the plates and inner surfaces of openings of the plates using surface tension to join the plates.

In this stacking-type header, if the amount (volume) of brazing material as the clad layers is large relative to the side surfaces of the plates and the inner surfaces of the openings of the plates on which the fillets are formed, an excess of brazing material will be generated. Disadvantageously, a large amount of the excess of brazing material may enter the refrigerant passages in the stacking-type header and thus block the passages.

The present invention has been made in view of the above-described disadvantage. The present invention aims to provide a stacking-type header including plates brazed together such that an excess of brazing material to be generated upon brazing is reduced to prevent blocking of a refrigerant passage. The present invention further aims to provide a heat exchanger including the stacking-type header. The present invention further aims to provide an air-conditioning apparatus including the heat exchanger.

SUMMARY

An embodiment of the present invention provides A stacking-type header comprising a plurality of first plates and a plurality of second plates stacked on one another, the plurality of second plates each being disposed between adjoining two of the plurality of first plates, the plurality of first plates including a first end plate being an outermost one of the plurality of first plates in a stacking direction of the plurality of first plates, the first end plate having a single first through hole, and a second end plate being an other outermost one of the plurality of first plates in the stacking direction of the plurality of first plates, the second end plate having a plurality of second through holes, the plurality of first plates and the plurality of second plates having a communication hole, the communication hole connecting the first single through hole of the first end plate and the plurality of second through holes of the second end plate, the plurality of second plates each having at least one opening formed at other than the communication hole, the at least one opening communicating with atmosphere.

Advantageous Effects of Invention

In the stacking-type header according to an embodiment of the present invention, the plurality of second plates each have the at least one opening formed at other than a distribution junction passage. The at least one opening communicates with the atmosphere. An excess of brazing material entering the opening upon brazing can flow toward a relatively low pressure atmospheric space. Thus, a melted brazing material in the opening will not have anywhere to flow, thus preventing an excess of brazing material from entering the distribution junction passage. This can prevent blocking of the distribution junction passage.

DETAILED DESCRIPTION

Figure 1:
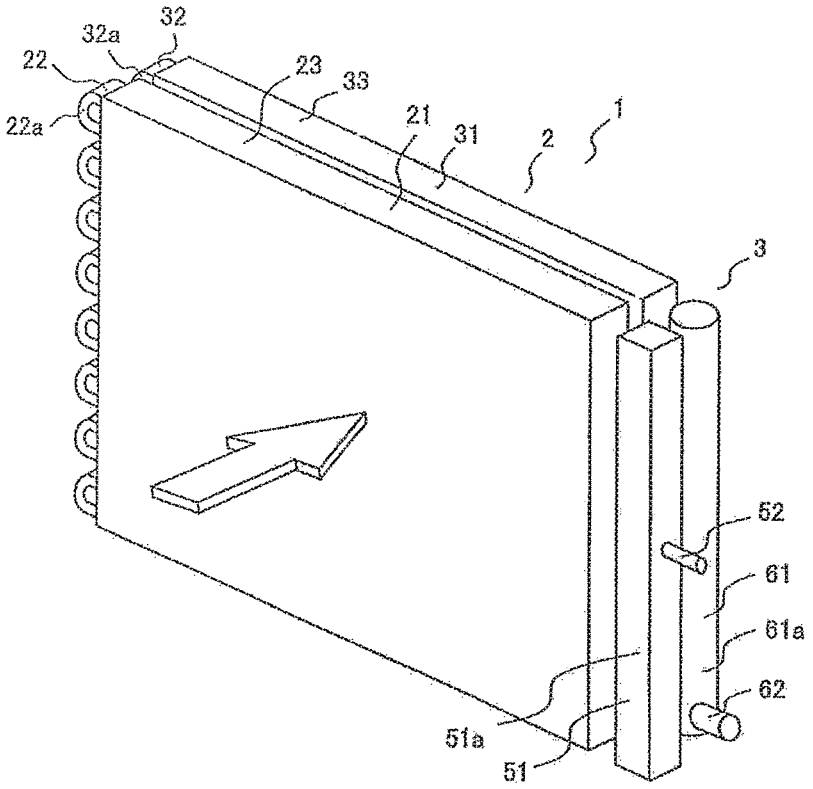
FIG. 1 is a perspective view of a heat exchanger according to Embodiment 1.

A stacking-type header, a heat exchanger, and an air-conditioning apparatus according to embodiments of the present invention will be described below with reference to the drawings.

In the following description, for example, configurations and operations are for illustrative purposes only, and should not be construed as limiting the stacking-type header, the heat exchanger, and the air-conditioning apparatus according to the present invention. In the drawings, the same or similar components are given the same reference signs or giving reference signs to the same or similar components is omitted. Furthermore, the illustration of details is simplified or omitted as appropriate. Additionally, redundant or similar description will be simplified or omitted as appropriate.

A case will be described where the stacking-type header and the heat exchanger according to the present invention are used in the air-conditioning apparatus. The present invention is not limited to the case. For example, the stacking-type header and the heat exchanger according to the present invention may be used in another refrigeration cycle apparatus including a refrigerant cycle circuit. Furthermore, a case will be described where the heat exchanger including the stacking-type header according to the present invention is an outdoor heat exchanger of the air-conditioning apparatus. The present invention is not limited to the case. The heat exchanger including the stacking-type header according to the present invention may be an indoor heat exchanger of the air-conditioning apparatus. In addition, a case will be described where the air-conditioning apparatus switches between a heating operation and a cooling operation. The present invention is not limited to the case. The air-conditioning apparatus may perform only the heating operation or the cooling operation.

Embodiment 1

A stacking-type header, a heat exchanger, and an air-conditioning apparatus according to Embodiment 1 will now be described.

<Configuration of Heat Exchanger>

(Schematic Configuration of Heat Exchanger)

A schematic configuration of the heat exchanger according to Embodiment 1 will be described below.

FIG. 1 is a perspective view of the heat exchanger according to Embodiment 1.

As illustrated in FIG. 1, the heat exchanger, 1, includes a heat exchange unit 2 and a distribution junction unit 3.

The heat exchange unit 2 includes an upstream heat exchange section 21, which is disposed on an upstream side in an air passing direction (indicated by an outlined arrow in FIG. 1) in which air passes through the heat exchange unit 2, and a downstream heat exchange section 31 disposed on a downstream side in the air passing direction. The upstream heat exchange section 21 includes a plurality of upstream heat transfer tubes 22 and a plurality of upstream fins 23 joined to the plurality of upstream heat transfer tubes 22 by, for example, brazing. The downstream heat exchange section 31 includes a plurality of downstream heat transfer tubes 32 and a plurality of downstream fins 33 joined to the downstream heat transfer tubes 32 by, for example, brazing. The heat exchange unit 2 may include two columns, or sections, that is, the upstream heat exchange section 21 and the downstream heat exchange section 31 or may include three or more columns.

The upstream heat transfer tubes 22 and the downstream heat transfer tubes 32 are flat tubes each having therein a plurality of passages. Each of the upstream heat transfer tubes 22 and the downstream heat transfer tubes 32 includes a bent portion 22*a* or 32*a* formed by bending part between a first end and a second end of the tube into a hairpin-like shape. The upstream heat transfer tubes 22 and the downstream heat transfer tubes 32 are arranged in multiple rows in a direction orthogonal to the air passing direction (indicated by the outlined arrow in FIG. 1) in which the air passes through the heat exchange unit 2. The first and second ends of the upstream heat transfer tubes 22 and the downstream heat transfer tubes 32 are arranged so as to face the distribution junction unit 3. The upstream heat transfer tubes 22 and the downstream heat transfer tubes 32 may be cylindrical tubes (e.g., cylindrical tubes having a diameter of 4 mm).

Instead of including the bent portions 22*a* and 32*a*, each formed by bending the part between the first and second ends of the tube into a hairpin-like shape, the upstream heat transfer tubes 22 and the downstream heat transfer tubes 32 may be connected by couplers each having therein passages. The first end of each of the upstream heat transfer tubes 22 and the downstream heat transfer tubes 32 may be connected to the first end of the upstream heat transfer tube 22 or the downstream heat transfer tube 32 in the next row through the coupler, through which the refrigerant turns.

The distribution junction unit 3 includes a stacking-type header 51 and a cylindrical header 61. The stacking-type header 51 and the cylindrical header 61 are arranged in the air passing direction (indicated by the outlined arrow in FIG. 1) in which the air passes through the heat exchange unit 2. The stacking-type header 51 is connected to a refrigerant pipe (not illustrated) by a connecting pipe 52. The cylindrical header 61 is connected to a refrigerant pipe (not illustrated) by a connecting pipe 62. The connecting pipes 52 and 62 are, for example, cylindrical tubes.

The stacking-type header 51 is connected to the upstream heat exchange section 21. The stacking-type header 51 has therein a distribution junction passage 51*a*. When the heat exchange unit 2 serves as an evaporator, the distribution junction passage 51*a* serves as a distribution passage through which the refrigerant flowing from the refrigerant pipe (not illustrated) is distributed to the upstream heat transfer tubes 22 of the upstream heat exchange section 21 such that refrigerant streams flow into the respective tubes. When the heat exchange unit 2 serves as a condenser, the distribution junction passage 51*a* serves as a junction passage through which the refrigerant streams flowing from the upstream heat transfer tubes 22 of the upstream heat exchange section 21 merge into a single stream flowing to the refrigerant pipe (not illustrated).

The distribution junction passage 51*a* corresponds to a communication hole in the present invention.

The cylindrical header 61 is connected to the downstream heat exchange section 31. The cylindrical header 61 has therein a distribution junction passage 61*a*. When the heat exchange unit 2 serves as a condenser, the distribution junction passage 61*a* serves as a distribution passage through which the refrigerant flowing from the refrigerant pipe (not illustrated) is distributed to the downstream heat transfer tubes 32 of the downstream heat exchange section 31 such that refrigerant streams flow into the respective tubes. When the heat exchange unit 2 serves as an evaporator, the distribution junction passage 61*a* serves as a junction passage through which the refrigerant streams flowing from the downstream heat transfer tubes 32 of the downstream heat exchange section 31 merge into a single stream flowing to the refrigerant pipe (not illustrated).

Specifically, the heat exchanger 1 includes, as separate components, the stacking-type header 51 providing the distribution passage (distribution junction passage 51*a*) and the cylindrical header 61 providing the junction passage (distribution junction passage 61*a*) when the heat exchange unit 2 serves as an evaporator.

In addition, the heat exchanger 1 includes, as separate components, the cylindrical header 61 providing the distribution passage (distribution junction passage 61*a*) and the stacking-type header 51 providing the junction passage (distribution junction passage 51*a*) when the heat exchange unit 2 serves as a condenser.

<Configuration of Stacking-Type Header>

The configuration of the stacking-type header 51 in the heat exchanger 1 according to Embodiment 1 will now be described.

Figure 2:
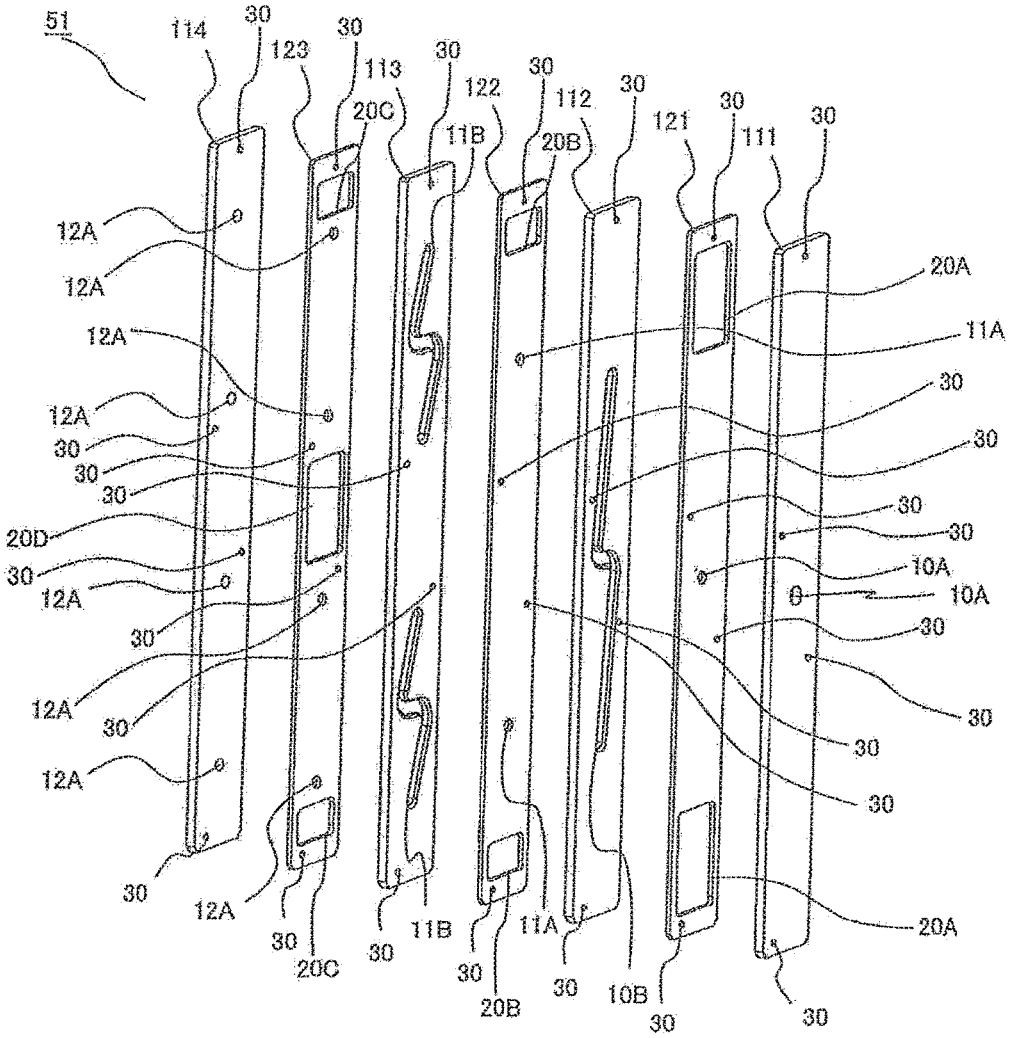
FIG. 2 is an exploded perspective view of a stacking-type header according to Embodiment 1.

FIG. 2 is an exploded perspective view of the stacking-type header according to Embodiment 1.

Figure 3:
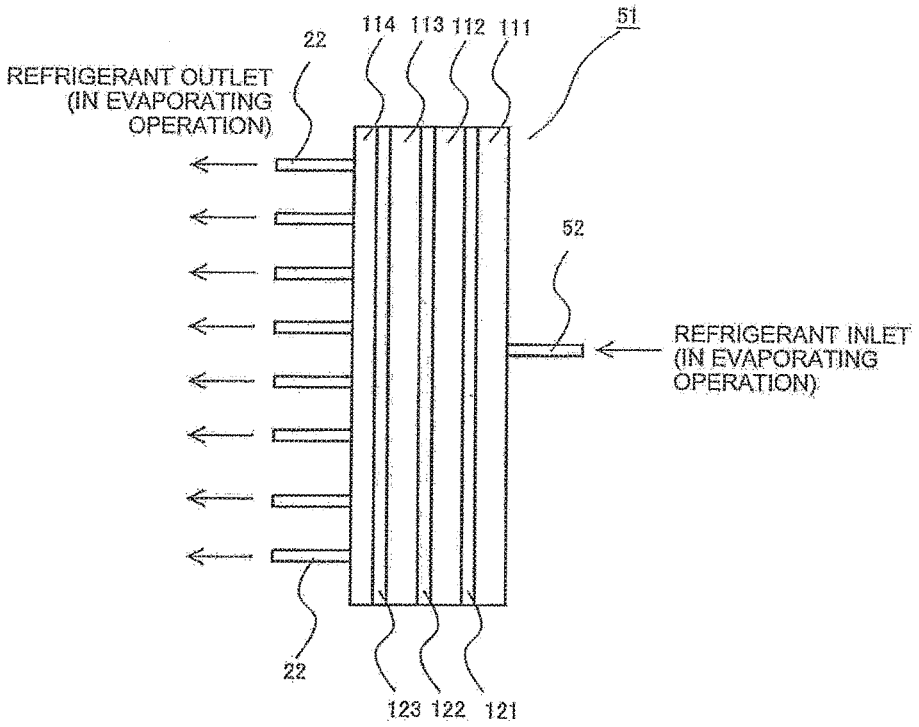
FIG. 3 is a side elevational view of the stacking-type header according to Embodiment 1.

FIG. 3 is a side elevational view of the stacking-type header according to Embodiment 1.

The stacking-type header 51 illustrated in FIGS. 2 and 3 includes a first plate 111 (first end plate in the present invention), first plates 112 and 113, a first plate 114 (second end plate in the present invention), and second plates 121, 122, and 123, each of which is disposed between adjoining two of the first plates. These plates have, for example, a rectangular shape. The first plates 111, 112, 113, and 114 and the second plates 121, 122, and 123 have the same outer shape in plan view.

Before the plates are joined by brazing, the first plates 111, 112, 113, and 114 are not cladded (or coated) with a brazing material and one or both surfaces of the second plates 121, 122, and 123 are cladded (or coated) with the brazing material. The first plates 111, 112, 113, and 114 and the second plates 121, 122, and 123 in such states are alternately stacked such that each of the second plates is disposed between adjoining two of the first plates, and are then heated in a heating furnace, thereby joining the plates by brazing. The first plates 111, 112, 113, and 114 and the second plates 121, 122, and 123 have a thickness ranging from, for example, approximately 1 to approximately 10 mm, and are made of aluminum.

In the stacking-type header 51, the distribution junction passage 51*a* is formed by first passage portions 10A, second passage portions 11A, third passage portions 12A, and dividing passage portions 10B and 11B arranged in the first plates 111, 112, 113, and 114 and the second plates 121, 122, and 123. The first, second, and third passage portions 10A, 11A, and 12A are circular through holes. The dividing passage portions 10B and 11B are substantially S-shaped or substantially Z-shaped through grooves. Furthermore, at least one of the second plates 121, 122, and 123 has an opening 20A, 20B, 20C, or 20D, serving as, for example, a rectangular hollow portion, which will be described in detail later.

Each plate is processed by stamping or cutting. To process the plate by stamping, a plate material having a thickness of 5 mm or less that can be processed by stamping may be used. To process the plate by cutting, a plate material having a thickness of 5 mm or greater may be used.

The refrigerant pipe of the refrigeration cycle apparatus is connected to the first passage portion 10A (first through hole in the present invention) of the first plate 111. The first passage portion 10A of the first plate 111 communicates with the connecting pipe 52 in FIG. 1.

Each of the first plate 111 and the second plate 121 has the first passage portion 10A, which is circular, in substantially central part of the plate. The second plate 122 has two of the second passage portions 11A, which are similarly circular, located on opposite sides of the first passage portions 10A.

Furthermore, each of the first plate 114 and the second plate 123 has the third passage portions 12A, which are circular, at four positions such that two third passage portions 12A are located on opposite sides of each second passage portion 11A. The third passage portions 12A (second through holes in the present invention) of the first plate 114 communicate with the upstream heat transfer tubes 22 in FIG. 1.

The first passage portions 10A, the second passage portions 11A, and the third passage portions 12A are positioned and arranged so as to communicate with one another when the first plates 111, 112, 113, and 114 and the second plates 121, 122, and 123 are stacked on one another.

Furthermore, the first plate 112 has the first dividing passage portion 10B and the first plate 113 has the second dividing passage portions 11B.

When the plates are stacked on one another and the distribution junction passage 51*a* is formed, the first passage portions 10A are connected to central part of the first dividing passage portion 10B of the first plate 112 and both ends of the first dividing passage portion 10B are connected to the third passage portions 12A.

In addition, the second passage portions 11A are connected to central parts of the second dividing passage portions 11B of the first plate 113 and both ends of each second dividing passage portion 11B are connected to the third passage portions 12A.

As described above, the first plates 111, 112, 113, and 114 and the second plates 121, 122, and 123 are stacked on one another and brazed together to connect the passage portions, thus forming the distribution junction passage 51*a*.

In addition, the first plates 111, 112, 113, and 114 and the second plates 121, 122, and 123 each have positioners 30 for positioning when the plates are stacked on one another.

Specifically, the positioners 30 are through holes. The plates can be positioned by extending pins through the through holes. The plates may be configured as follows: one of the facing plates has a recess and the other one of them has a protrusion such that the recess engages with the protrusion when the plates are stacked together.

<Refrigerant Flow in Stacking-Type Header>

The distribution junction passage 51*a* and a refrigerant flow in the stacking-type header 51 will now be described.

When the heat exchanger 1 serves as an evaporator, two-phase gas-liquid refrigerant flows into the stacking-type header 51 through the first passage portion 10A of the first plate 111. The refrigerant that has flowed into the stacking-type header 51 flows straight through the first passage portions 10A and then collides with the surface of the second plate 122 in the first dividing passage portion 10B of the first plate 112, so that the refrigerant divides into an upward stream and a downward stream in the direction of gravity.

The refrigerant streams respectively flow to both ends of the first dividing passage portion 10B and flow into the two second passage portions 11A.

Each refrigerant stream that has flowed into the second passage portion 11A flows straight through the second passage portion 11A in the same direction as that in which the refrigerant flows through the first passage portions 10A. This refrigerant stream collides with the surface of the second plate 123 in the second dividing passage portion 11B of the first plate 113, so that the refrigerant stream divides into an upward stream and a downward stream in the gravity direction.

The refrigerant streams respectively flow to both ends of each of the second dividing passage portions 11B. Then, the refrigerant streams flow into the four third passage portions 12A.

The refrigerant streams that have flowed into the third passage portions 12A flow straight through the third passage portions 12A in the same direction as that in which the refrigerant streams flow through the second passage portions 11A.

The refrigerant streams flow out of the third passage portions 12A and are then evenly distributed to the upstream heat transfer tubes 22 of the upstream heat exchange section 21 through passages of a holder, so that the refrigerant flows into the upstream heat transfer tubes 22.

In Embodiment 1, the stacking-type header 51, which has been described as an example, includes the distribution junction passage 51*a* through which the refrigerant passes through the dividing passage portions twice such that the refrigerant is divided into four refrigerant streams, that is, the number of divisions is four. The number of divisions is not particularly limited.

<Configurations of Openings of Second Plates>

The configurations of the openings 20A, 20B, 20C, and 20D in the second plates 121, 122, and 123 will now be described with reference to FIG. 2.

The rectangular second plate 121 has two openings 20A having a substantially rectangular shape in both end portions of the second plate 121 in its longitudinal direction.

Each of the openings 20A does not communicate with the first passage portion 10A, so that the refrigerant will not enter the opening 20A. In the second plate 121, part, serving as four sides of the opening 20A, surrounding the opening 20A is continuously formed. When the first plates 111 and 112 are brazed to both surfaces of the second plate 121, the inside of the opening 20A serves as an enclosed space.

Like the second plate 121 having the openings 20A, the rectangular second plate 122 has two openings 20B having a substantially rectangular shape in both end portions of the second plate 122 in its longitudinal direction. The openings 20B also do not communicate with the second passage portions 11A, so that the refrigerant will not enter the openings 20B. In the second plate 122, part, serving as four sides of each of the openings 20B, surrounding the opening 20B is continuously formed. When the first plates 112 and 113 are brazed to both surfaces of the second plate 122, the inside of the opening 20B serves as an enclosed space.

In addition, the rectangular second plate 123 has two openings 20C having a substantially rectangular shape in both end portions of the second plate 123 in its longitudinal direction. The second plate 123 further has one opening 20D in central part of the plate in the longitudinal direction.

The openings 20C and 20D also do not communicate with the third passage portions 12A, so that the refrigerant will not enter the openings 20C and 20D. In the second plate 123, part, serving as four sides of each of the openings 20C and 20D, surrounding the opening is continuously formed. When the first plates 113 and 114 are brazed to both surfaces of the second plate 123, the inside of each of the openings 20C and 20D serves as an enclosed space.

The above-described formation of the openings 20A, 20B, 20C, and 20D in the second plates 121, 122, and 123 can reduce the amount of brazing material to be applied to the second plates 121, 122, and 123. In addition, when the stacking-type header 51 is assembled by brazing, fillets are formed on inner surfaces of the openings 20A, 20B, 20C, and 20D. The reduction in the amount of brazing material to be applied to the second plates 121, 122, and 123 and the formation of fillets, resulting from an excess of brazing material, on the inner surfaces of the openings 20A, 20B, 20C, and 20D reduce a likelihood that the excess of brazing material may enter the distribution junction passage 51*a*, thus eliminating causes of defects, such as blocking and narrowing of the passage.

Furthermore, the above-described configuration results in a reduction in weight of the stacking-type header 51, leading to a reduction in thermal capacity. Thus, brazing time can be shortened.

Although the openings 20A, 20B, 20C, and 20D have, as an example, a substantially rectangular shape, these openings can have any of various shapes, such as a circle, an oval, and a triangle.

<Connection of Heat Exchange Unit and Distribution Junction Unit>

Connection of the heat exchange unit and the distribution junction unit of the heat exchanger according to Embodiment 1 will be described below.

Figure 4:
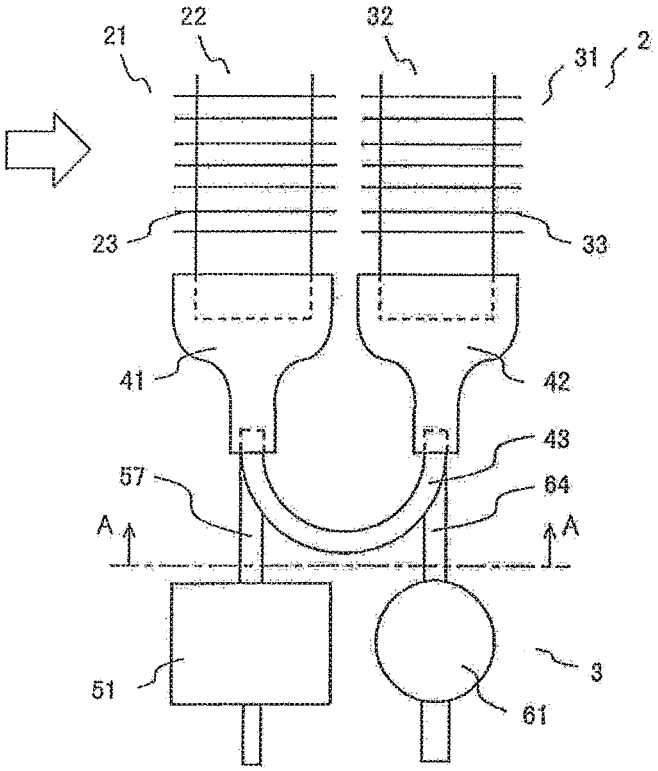
FIG. 4 is a diagram explaining connection of a heat exchange unit and a distribution junction unit of the heat exchanger according to Embodiment 1.
Figure 5:
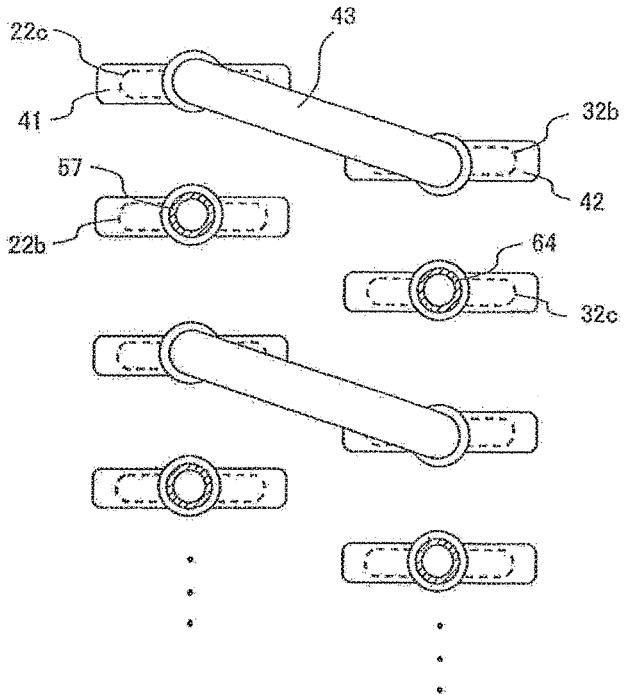
FIG. 5 is a diagram explaining the connection of the heat exchange unit and the distribution junction unit of the heat exchanger according to Embodiment 1.

FIGS. 4 and 5 are diagrams explaining the connection of the heat exchange unit and the distribution junction unit of the heat exchanger according to Embodiment 1. FIG. 5 is a sectional view taken along the line A-A in FIG. 4.

Referring to FIGS. 4 and 5, the upstream heat transfer tubes 22 have first ends 22*b* and second ends 22*c* joined to upstream joint members 41. The upstream joint members 41 each have therein a passage, which has a first end fitted on an outer surface of the upstream heat transfer tube 22 and a second end having a circular shape. The downstream heat transfer tubes 32 have first ends 32*b* and second ends 32*c* joined to downstream joint members 42. The downstream joint members 42 each have therein a passage, which has a first end fitted on an outer surface of the downstream heat transfer tube 32 and a second end having a circular shape.

The upstream joint members 41 joined to the second ends 22*c* of the upstream heat transfer tubes 22 are connected to the downstream joint members 42 joined to the first ends 32*b* of the downstream heat transfer tubes 32 by column connecting pipes 43. Each of the column connecting pipes 43 is a cylindrical tube bent in an arcuate shape, for example. The upstream joint members 41 joined to the first ends 22*b* of the upstream heat transfer tubes 22 are connected to connecting pipes 57 of the stacking-type header 51. The downstream joint members 42 joined to the second ends 32*c* of the downstream heat transfer tubes 32 are connected to connecting pipes 64 of the cylindrical header 61.

The upstream joint member 41 and the connecting pipe 57 may be integrated in one piece. Furthermore, the downstream joint member 42 and the connecting pipe 64 may be integrated in one piece. Additionally, the upstream joint member 41, the downstream joint member 42, and the column connecting pipe 43 may be integrated in one piece.

Figure 6:
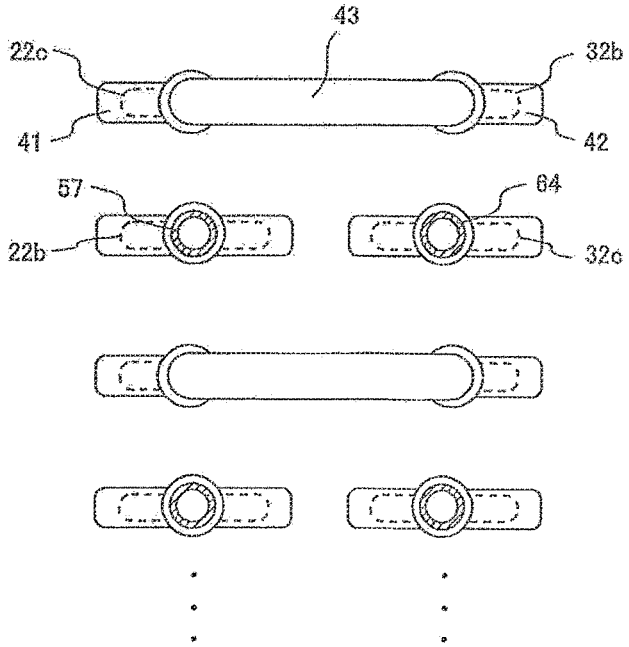
FIG. 6 is a diagram explaining connection of a heat exchange unit and a distribution junction unit of a heat exchanger according to a modification of Embodiment 1.

FIG. 6 is a diagram explaining connection of a heat exchange unit and a distribution junction unit of a heat exchanger according to a modification of Embodiment 1.

FIG. 6 is a sectional view taken along a line corresponding to the line A-A in FIG. 4.

As illustrated in FIG. 5, the upstream heat transfer tubes 22 and the downstream heat transfer tubes 32 may be arranged such that the first ends 22*b* and the second ends 22*c* of the upstream heat transfer tubes 22 and the first ends 32*b* and the second ends 32*c* of the downstream heat transfer tubes 32 are arranged in a staggered pattern when the heat exchanger 1 is viewed from the side. As illustrated in FIG. 6, the upstream heat transfer tubes 22 and the downstream heat transfer tubes 32 may be arranged such that the first ends 22*b* and the second ends 22*c* of the upstream heat transfer tubes 22 and the first ends 32*b* and the second ends 32*c* of the downstream heat transfer tubes 32 are arranged in a tessellated pattern.

<Configuration of Air-Conditioning Apparatus Including Heat Exchanger>

The configuration of the air-conditioning apparatus including the heat exchanger according to Embodiment 1 will be described below.

Figure 7:
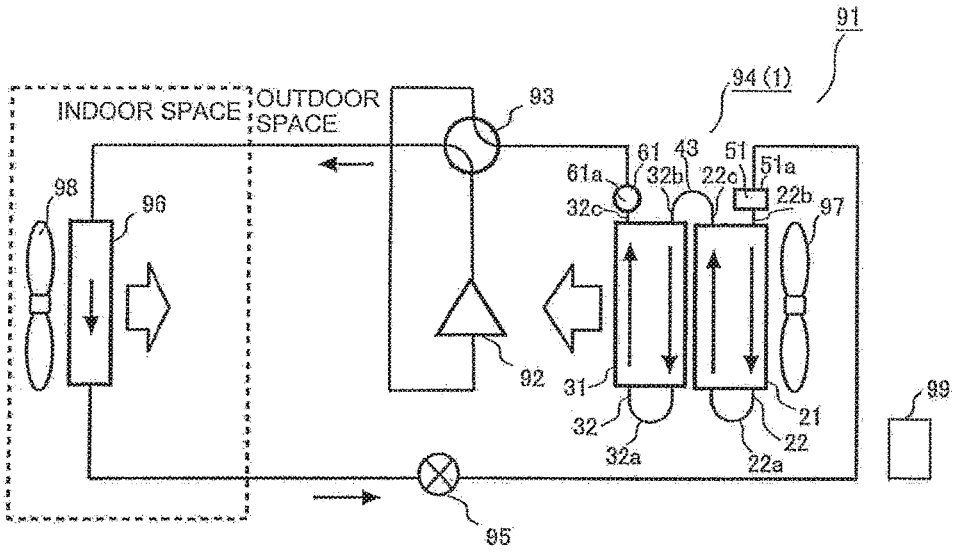
FIG. 7 is a diagram illustrating the configuration of an air-conditioning apparatus including the heat exchanger according to Embodiment 1.
Figure 8:
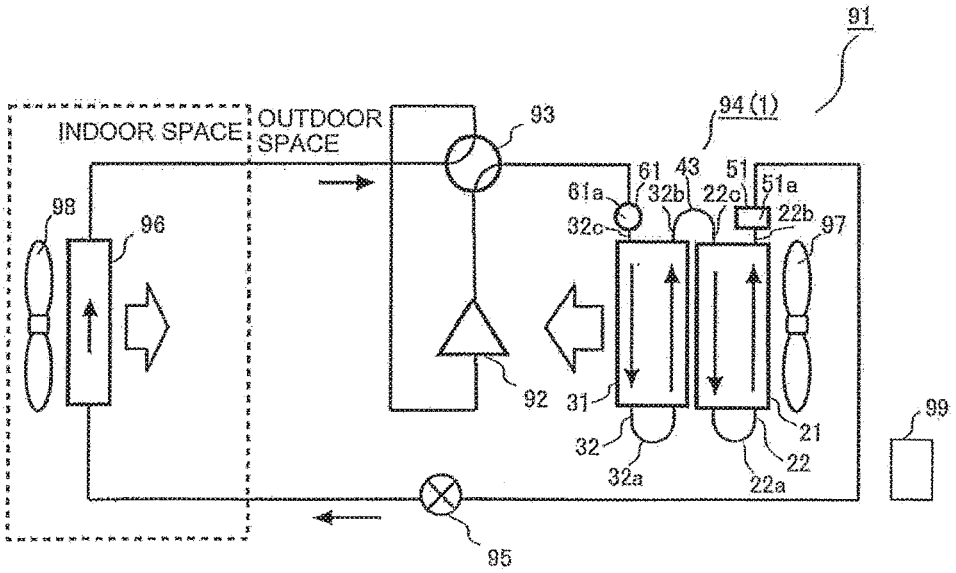
FIG. 8 is a diagram illustrating the configuration of the air-conditioning apparatus including the heat exchanger according to Embodiment 1.

FIGS. 7 and 8 are diagrams illustrating the configuration of the air-conditioning apparatus including the heat exchanger according to Embodiment 1. FIG. 7 illustrates a case where the air-conditioning apparatus, 91, performs a heating operation. FIG. 8 illustrates a case where the air-conditioning apparatus 91 performs a cooling operation.

As illustrated in FIGS. 7 and 8, the air-conditioning apparatus 91 includes a compressor 92, a four-way valve 93, an outdoor heat exchanger (heat source side heat exchanger) 94, an expansion device 95, an indoor heat exchanger (load side heat exchanger) 96, an outdoor fan (heat source side fan) 97, an indoor fan (load side fan) 98, and a controller 99. The compressor 92, the four-way valve 93, the outdoor heat exchanger 94, the expansion device 95, and the indoor heat exchanger 96 are connected by refrigerant pipes, thus forming a refrigerant cycle circuit. Another flow switching device may be used instead of the four-way valve 93.

The outdoor heat exchanger 94 corresponds to the heat exchanger 1. The heat exchanger 1 is installed such that the stacking-type header 51 is disposed on the upstream side in a direction of air flow generated by driving the outdoor fan 97 and the cylindrical header 61 is disposed on the downstream side in the air flow direction. The outdoor fan 97 may be disposed upstream of the heat exchanger 1 or may be disposed downstream of the heat exchanger 1.

For example, the compressor 92, the four-way valve 93, the expansion device 95, the outdoor fan 97, the indoor fan 98, and various sensors are connected to the controller 99. The controller 99 causes the four-way valve 93 to switch between passages in the valve, thus switching between the heating operation and the cooling operation.

<Operations of Heat Exchanger and Air-Conditioning Apparatus>

Operations of the heat exchanger according to Embodiment 1 and operations of the air-conditioning apparatus including the heat exchanger will be described below.

(Operations of Heat Exchanger and Air-Conditioning Apparatus in Heating Operation)

A refrigerant flow in the heating operation will now be described with reference to FIG. 7.

High-pressure, high-temperature gas refrigerant discharged from the compressor 92 flows into the indoor heat exchanger 96 via the four-way valve 93. In the indoor heat exchanger 96, the refrigerant exchanges heat with air supplied by the indoor fan 98 and thus condenses, thereby heating an indoor space. The condensed refrigerant turns into a high-pressure, subcooled liquid state. The refrigerant flows out of the indoor heat exchanger 96 and passes through the expansion device 95, which causes the refrigerant to turn into low-pressure, two-phase gas-liquid refrigerant. The low-pressure, two-phase gas-liquid refrigerant flows into the outdoor heat exchanger 94, in which the refrigerant exchanges heat with air supplied by the outdoor fan 97 and thus evaporates into a low-pressure, superheated gas state. The refrigerant flows out of the outdoor heat exchanger 94, passes through the four-way valve 93, and is sucked into the compressor 92. Specifically, the outdoor heat exchanger 94 serves as an evaporator in the heating operation.

In the outdoor heat exchanger 94, the refrigerant flows into the distribution junction passage 51*a* of the stacking-type header 51, where the refrigerant is distributed, or divided into refrigerant streams. The refrigerant streams flow into the first ends 22*b* of the upstream heat transfer tubes 22 in the upstream heat exchange section 21. The refrigerant streams that have flowed into the first ends 22*b* of the upstream heat transfer tubes 22 pass through the bent portions 22*a* to the second ends 22*c* of the upstream heat transfer tubes 22 and then flow through the column connecting pipes 43 into the first ends 32*b* of the downstream heat transfer tubes 32 in the downstream heat exchange section 31. The refrigerant streams that have flowed into the first ends 32*b* of the downstream heat transfer tubes 32 pass through the bent portions 32*a* to the second ends 32*c* of the downstream heat transfer tubes 32 and then flow into the distribution junction passage 61*a* of the cylindrical header 61, where the refrigerant streams merge together.

(Operations of Heat Exchanger and Air-Conditioning Apparatus in Cooling Operation)

A refrigerant flow in the cooling operation will now be described with reference to FIG. 8.

High-pressure, high-temperature gas refrigerant discharged from the compressor 92 flows into the outdoor heat exchanger 94 via the four-way valve 93. In the outdoor heat exchanger 94, the refrigerant exchanges heat with the air supplied by the outdoor fan 97 and thus condenses into a high-pressure, subcooled liquid state (or a low-quality, two-phase gas-liquid state). The refrigerant flows out of the outdoor heat exchanger 94 and passes through the expansion device 95, which causes the refrigerant to turn into a low-pressure, two-phase gas-liquid state. The low-pressure, two-phase gas-liquid refrigerant flows into the indoor heat exchanger 96, in which the refrigerant exchanges heat with the air supplied by the indoor fan 98 and thus evaporates, thereby cooling the indoor space. The evaporated refrigerant turns into a low-pressure, superheated gas state. The refrigerant flows out of the indoor heat exchanger 96, passes through the four-way valve 93, and is sucked into the compressor 92. Specifically, the outdoor heat exchanger 94 serves as a condenser in the cooling operation.

In the outdoor heat exchanger 94, the refrigerant flows into the distribution junction passage 61*a* of the cylindrical header 61, where the refrigerant is distributed, or divided into refrigerant streams. The refrigerant streams flow into the second ends 32*c* of the downstream heat transfer tubes 32 in the downstream heat exchange section 31. The refrigerant streams that have flowed into the second ends 32*c* of the downstream heat transfer tubes 32 pass through the bent portions 32*a* to the first ends 32*b* of the downstream heat transfer tubes 32 and then flow through the column connecting pipes 43 into the second ends 22*c* of the upstream heat transfer tubes 22 in the upstream heat exchange section 21. The refrigerant streams that have flowed into the second ends 22*c* of the upstream heat transfer tubes 22 pass through the bent portions 22*a* to the first ends 22*b* of the upstream heat transfer tubes 22 and then flow into the distribution junction passage 51*a* of the stacking-type header 51, where the refrigerant streams merge together.

Embodiment 2

A stacking-type header according to Embodiment 2 will be described.

A description that is a duplication of or similar to that in Embodiment 1 will be simplified or omitted as appropriate.

A stacking-type header 51 according to Embodiment 2 differs from the stacking-type header 51 according to Embodiment 1 only in the configurations of the openings in the second plates. The difference will be described. The stacking-type header 51 according to Embodiment 2 can be used in a heat exchanger and an air-conditioning apparatus in a manner similar to the stacking-type header 51 according to Embodiment 1.

<Configurations of Openings of Second Plates>

Figure 9:
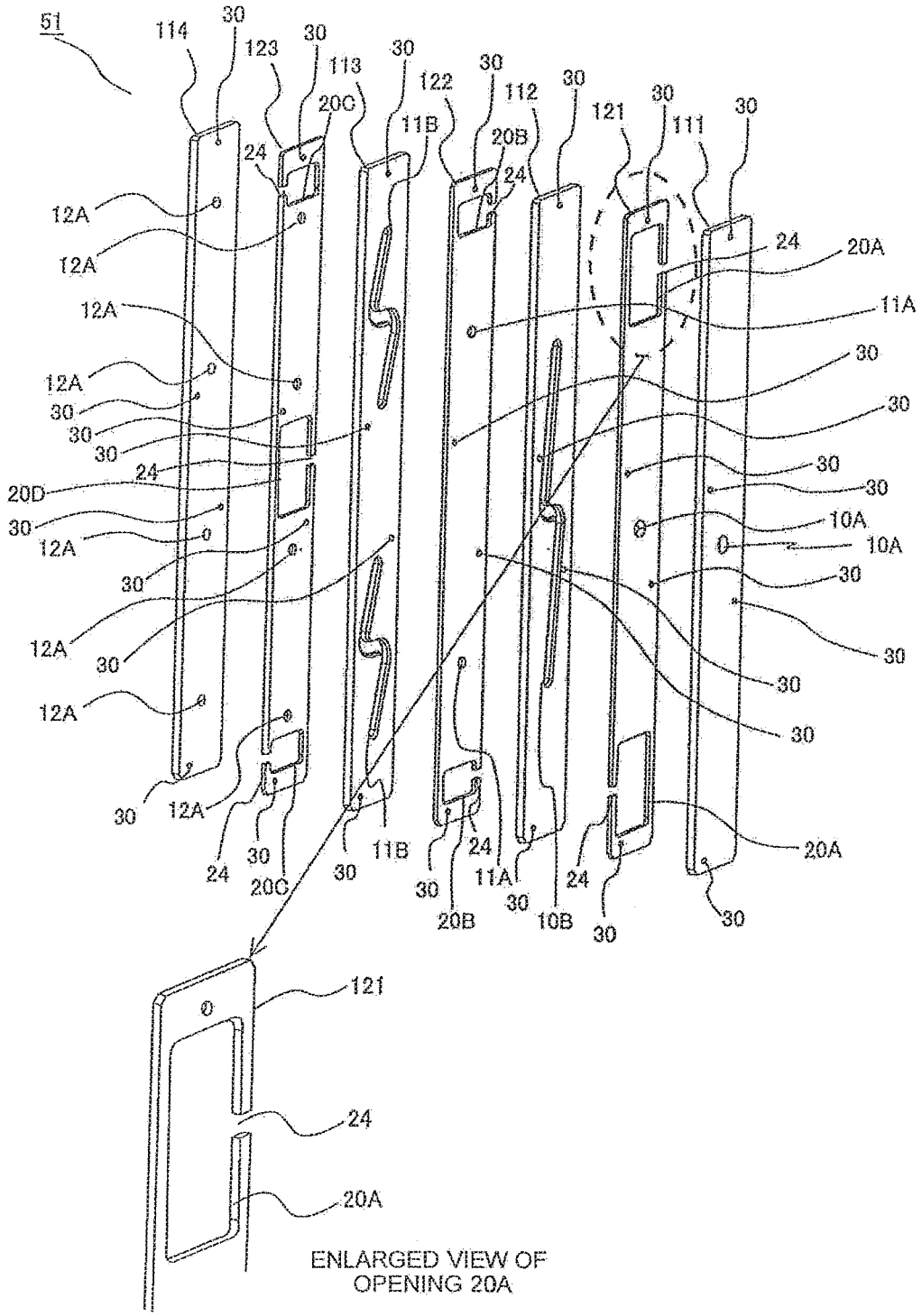
FIG. 9 is an exploded perspective view of a stacking-type header according to Embodiment 2.

FIG. 9 is an exploded perspective view of the stacking-type header according to Embodiment 2.

First plates 111, 112, 113, and 114 and second plates 121, 122, and 123 have the same configurations as those in Embodiment 1.

The configurations of openings 20A, 20B, 20C, and 20D in the second plates 121, 122, and 123 will be described with reference to FIG. 2.

The rectangular second plate 121 has two openings 20A having a substantially rectangular shape in both end portions of the second plate 121 in its longitudinal direction.

Each of the openings 20A does not communicate with a first passage portion 10A, so that the refrigerant will not enter the opening 20A. In the second plate 121, part corresponding to at least one of four sides of the opening 20A has a cut-out 24 through which the opening communicates with atmosphere, as illustrated in an enlarged view in FIG. 9. Consequently, when the first plates 111 and 112 are brazed to both surfaces of the second plate 121, the inside of the opening 20A serves as an open space that communicates with the atmosphere.

Like the second plate 121 having the openings 20A, the rectangular second plate 122 has two openings 20B having a substantially rectangular shape in both end portions of the second plate 122 in its longitudinal direction. Each of the openings 20B does not communicate with a second passage portion 11A, so that the refrigerant will not enter the opening 20B. In the second plate 122, part corresponding to at least one of four sides of the opening 20B has a cut-out 24 through which the opening 20B communicates with the atmosphere. Consequently, when the first plates 112 and 113 are brazed to both surfaces of the second plate 122, the inside of the opening 20B serves as an open space that communicates with the atmosphere.

Furthermore, the rectangular second plate 123 has two openings 20C having a substantially rectangular shape in both end portions of the second plate 123 in its longitudinal direction. The second plate 122 further has one opening 20D in central part of the plate in the longitudinal direction.

The openings 20C and 20D also do not communicate with third passage portions 12A, so that the refrigerant will not enter the openings 20C and 20D. In the second plate 123, part corresponding to at least one of four sides of each of the openings 20C and 20D has a cut-out 24 through which the opening communicates with the atmosphere. Consequently, when the first plates 113 and 114 are brazed to both surfaces of the second plate 123, the inside of each of the openings 20C and 20D serves as an open space that communicates with the atmosphere.

The formation of the openings 20A, 20B, 20C, and 20D in the second plates 121, 122, and 123 can lead to a reduction in the amount of brazing material to be applied to the second plates 121, 122, and 123. Furthermore, an excess of brazing material can be retained as fillets on inner surfaces of the openings 20A, 20B, 20C, and 20D, thus eliminating likelihood that the excess of brazing material may enter a distribution junction passage 51*a*. This can eliminate causes of defects, such as blocking and narrowing of the passage.

In addition, the cut-outs 24 through which the openings 20A, 20B, 20C, and 20D communicate with the atmosphere are arranged next to the respective openings. Such a simple configuration allows a brazing material entering the openings 20A, 20B, 20C, and 20D to flow toward a relatively low pressure atmospheric space.

Consequently, a melted brazing material in the openings 20A, 20B, 20C, and 20D will not have anywhere to flow. The simple configuration with the cut-outs 24 can prevent an excess of brazing material from entering the distribution junction passage 51*a*.

Furthermore, the above-described configuration results in a reduction in weight of the stacking-type header 51, leading to a reduction in thermal capacity. Thus, brazing time can be shortened.

Although the openings 20A, 20B, 20C, and 20D have, as an example, a substantially rectangular shape, these openings can have any of various shapes, such as a circle, an oval, and a triangle.

Embodiment 3

A stacking-type header according to Embodiment 3 will be described.

A description that is a duplication of or similar to that in Embodiment 1 will be simplified or omitted as appropriate.

In the stacking-type headers 51 according to Embodiments 1 and 2, the first plates 111, 112, 113, and 114 and the second plates 121, 122, and 123 have the same outer shape in plan view. A stacking-type header 51 according to Embodiment 3 differs from the stacking-type headers 51 according to Embodiments 1 and 2 in that plates have different outer shapes. The stacking-type header 51 according to Embodiment 3 can be used in a heat exchanger and an air-conditioning apparatus in a manner similar to the stacking-type headers 51 according to Embodiments 1 and 2.

<Configuration of Stacking-Type Header>

Figure 10:
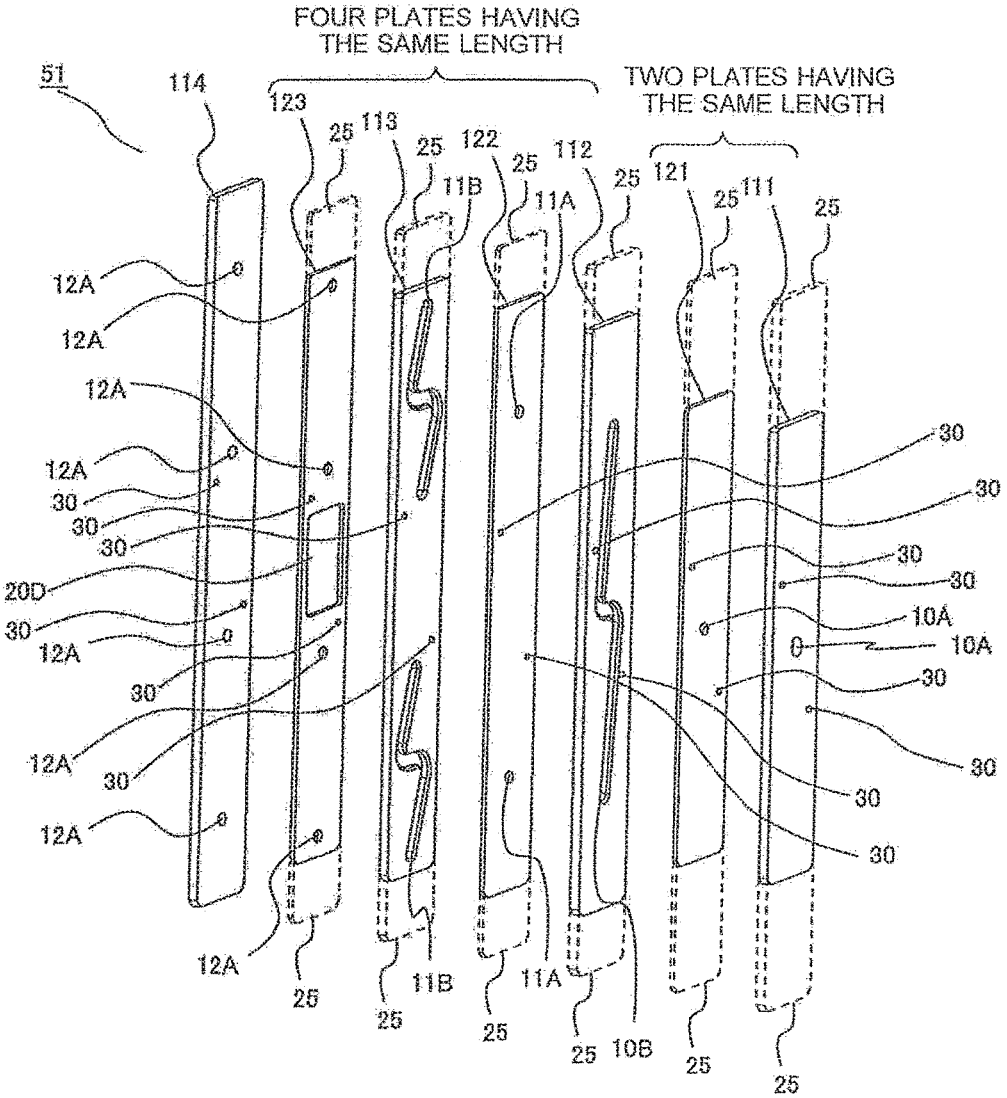
FIG. 10 is an exploded perspective view of a stacking-type header according to Embodiment 3.

FIG. 10 is an exploded perspective view of the stacking-type header according to Embodiment 3.

Figure 11:
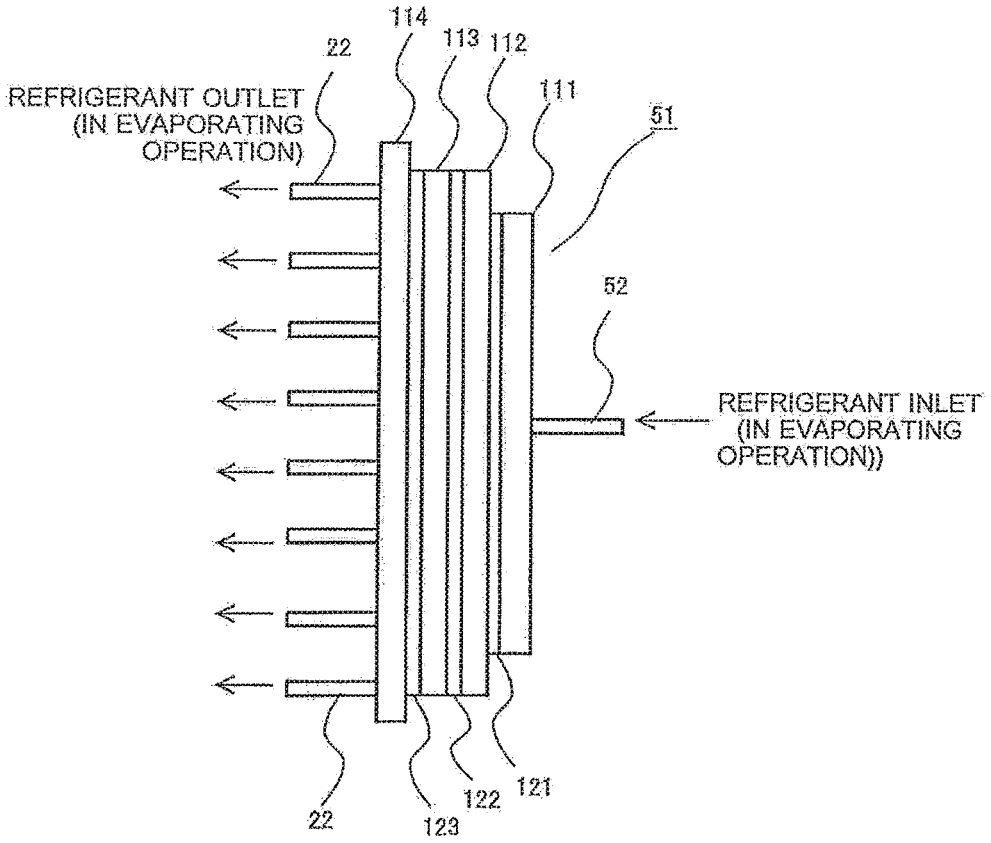
FIG. 11 is a side elevational view of the stacking-type header according to Embodiment 3.

FIG. 11 is a side elevational view of the stacking-type header according to Embodiment 3.

Like the stacking-type headers 51 according to Embodiments 1 and 2, the stacking-type header 51 illustrated in FIGS. 10 and 11 includes first plates 111, 112, 113, and 114 and second plates 121, 122, and 123, each of which is disposed between adjoining two of the first plates. These plates have, for example, a rectangular shape.

One or both surfaces of each of the second plates 121, 122, and 123 are cladded (or coated) with a brazing material. The first plates 111, 112, 113, and 114 and the second plates 121, 122, and 123 are stacked on one another such that each second plate is disposed between adjoining two of the first plates, and are joined together by brazing. Thus, the same refrigerant passage as the distribution junction passages 51*a* according to Embodiments 1 and 2 is formed inside the stacking-type header 51.

As illustrated in FIGS. 10 and 11, the stacking-type header 51 according to Embodiment 3 includes the first plates 111, 112, 113, and 114 and the second plates 121, 122, and 123 that have different lengths in their longitudinal direction (vertical direction in FIG. 11) in plan view. Furthermore, the first plates 111, 112, 113, and 114 and the second plates 121, 122, and 123 have the same length or dimension in their lateral direction (direction into or out of the page of FIG. 11) in plan view.

More specifically, the first plate 114, to which upstream heat transfer tubes 22 are connected, is formed so as to have a dimension in the longitudinal direction longer than any other plate. Then, the first plates 112 and 113 and the second plates 122 and 123 are formed so as to have the same dimension in the longitudinal direction by cutting and removing, as cut portions 25, both end portions of these plates in the longitudinal direction such that the four plates are the second longest. Finally, the first plate 111 and the second plate 121 are formed so as to have the same dimension in the longitudinal direction by cutting and removing, as cut portions 25, both end portions of these plates in the longitudinal direction such that the two plates are the shortest.

The dimension in the longitudinal direction of each of these plates is determined by cutting, as cut portions 25, unnecessary portions corresponding to the openings 20A, 20B, or 20C according to Embodiments 1 and 2 and extending from both the ends of the plate.

More specifically, the dimension in the longitudinal direction of the first plate 111 and the second plate 121 is determined by cutting, as cut portions 25, both end portions of the plates at sides of the openings 20A adjacent to the first passage portion 10A in FIGS. 2 and 9. Similarly, the dimension in the longitudinal direction of the first plates 112 and 113 and the second plates 122 and 123 is determined by cutting, as cut portions 25, both end portions of the plates at sides of the openings 20B or 20C adjacent to the second passage portions 11A or the third passage portions 12A in FIGS. 2 and 9.

As described above, the plates are cut such that the dimensions of the plates in the longitudinal direction gradually decrease from the first plate 114, to which the upstream heat transfer tubes 22 are connected, to the first plate 111 to which the connecting pipe 52 is connected. Such a configuration allows the unnecessary portions of the second plates 121, 122, and 123, which are unnecessary to form the distribution junction passage 51*a*, to be eliminated as cut portions 25. This leads to a reduction in the amount of brazing material to be applied to the second plates 121, 122, and 123, thus eliminating a likelihood that an excess of brazing material may enter the distribution junction passage 51*a*. This can eliminate causes of defects, such as blocking and narrowing of the passage.

Furthermore, the order of assembling the first plates 111, 112, 113, and 114 and the second plates 121, 122, and 123, each of which is disposed between adjoining two of the first plates, can be easily specified, thus improving productivity.

In addition, the above-described configuration results in a reduction in weight of the stacking-type header 51, leading to a reduction in thermal capacity. Thus, brazing time can be shortened.

Additionally, previously cutting the unnecessary portions of the plates, excluding portions necessary for the distribution junction passage 51*a*, can reduce the cost.

The stacking-type header 51 according to Embodiment 3 can also have an opening 20D, which is located in the central part of the second plate in Embodiments 1 and 2. Using the opening 20D can further reduce an unnecessary brazing material. Advantageously, causes of defects, such as blocking and narrowing of the distribution junction passage 51*a*, can be eliminated.

Embodiment 4

A stacking-type header according to Embodiment 4 will be described.

A description that is a duplication of or similar to that in Embodiment 1 will be simplified or omitted as appropriate.

A stacking-type header 51 according to Embodiment 4 differs from the stacking-type header 51 according to Embodiment 1 in the configurations of the openings in the second plates and the configurations of connection holes through which the openings communicate with the atmosphere. The difference will be described. The stacking-type header 51 according to Embodiment 4 can be used in a heat exchanger and an air-conditioning apparatus in a manner similar to the stacking-type header 51 according to Embodiment 1.

<Configurations of Openings in Second Plates>

Figure 12:
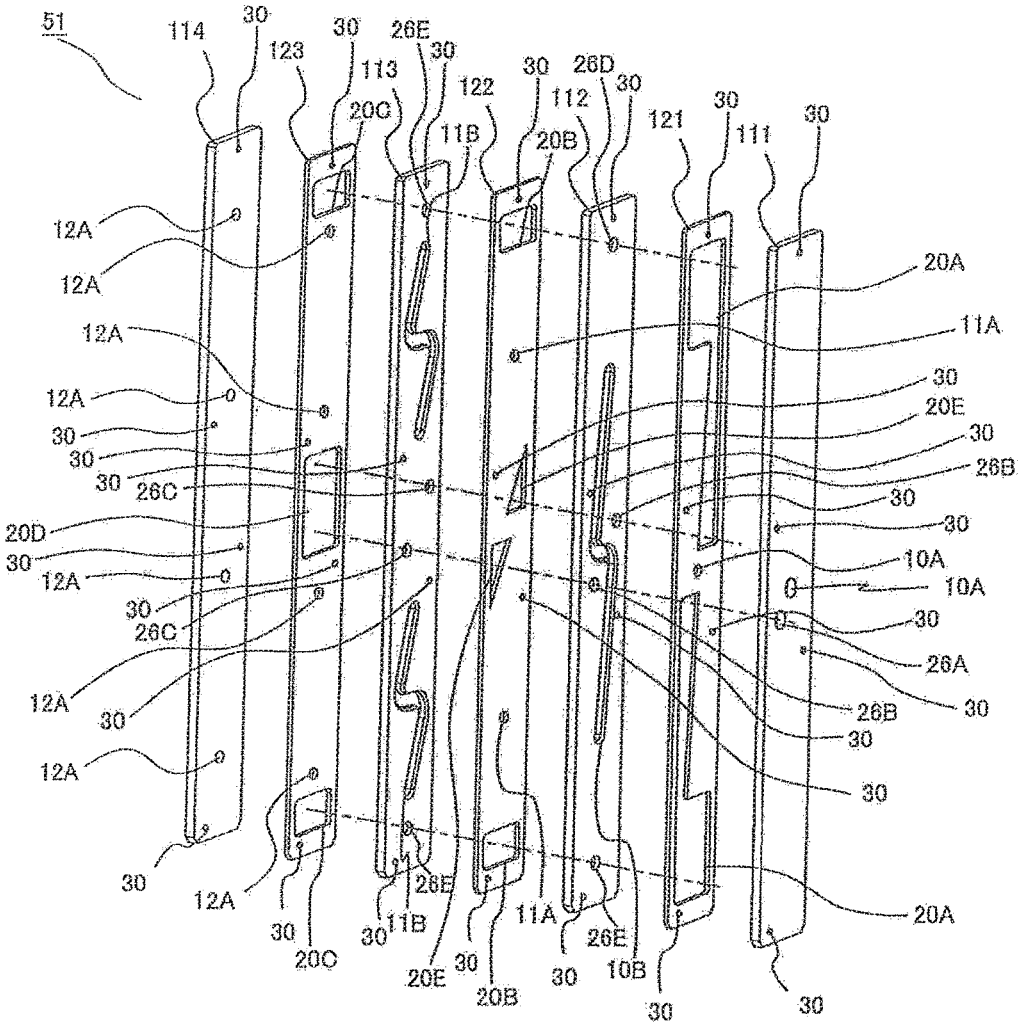
FIG. 12 is an exploded perspective view of a stacking-type header according to Embodiment 4.

FIG. 12 is an exploded perspective view of the stacking-type header according to Embodiment 4.

First plates 111, 112, 113, and 114 and second plates 121, 122, and 123 have the same fundamental configurations as those in Embodiment 1.

The configurations of openings 20A, 20B, 20C, 20D, and 20E in the second plates 121, 122, and 123 will now be described with reference to FIG. 12.

The rectangular second plate 121 has two openings 20A having a substantially ax-like shape such that the openings extend from both end portions of the second plate 121 in its longitudinal direction toward the center of the plate. Each of the openings 20A is a combination of a rectangular opening and an elongated opening.

The openings 20A do not communicate with a first passage portion 10A, so that the refrigerant will not enter the openings 20A.

Like the second plate 121 having the openings 20A, the rectangular second plate 122 has two openings 20B having a substantially rectangular shape in both end portions of the second plate 122 in its longitudinal direction. The second plate 122 further has two openings 20E having a substantially triangular shape in central part of the plate in the longitudinal direction. The openings 20B and 20E do not communicate with second passage portions 11A, so that the refrigerant will not enter the openings 20B and 20E.

Furthermore, the rectangular second plate 123 has two openings 20C having a substantially rectangular shape in both end portions of the second plate 123 in its longitudinal direction. The second plate 122 further has one opening 20D in central part of the plate in the longitudinal direction. The openings 20C and 20D do not communicate with third passage portions 12A, so that the refrigerant will not enter the openings 20C and 20D.

The configuration of an atmosphere open hole 26A and the configurations of connection holes 26B, 26C, 26D, and 26E in the first plates 111, 112, and 113 will now be described with reference to FIG. 12.

The first plate 111 has the atmosphere open hole 26A having a circular shape in substantially central part of the first plate 111 in its longitudinal direction. The atmosphere open hole 26A communicates with one of the openings 20A of the second plate 121 when the plates are stacked on one another.

Furthermore, the first plate 112 has two connection holes 26B having a circular shape in substantially central part of the first plate 112 in its longitudinal direction. The connection holes 26B communicate with the two openings 20A of the second plate 121 and the two openings 20E of the second plate 122 when the plates are stacked on one another.

In addition, the first plate 112 has two connection holes 26D having a circular shape in both end portions of the first plate 112 in the longitudinal direction. The connection holes 26D communicate with the two openings 20A of the second plate 121 and the two openings 20B of the second plate 122 when the plates are stacked on one another.

Furthermore, the first plate 113 has two connection holes 26C having a circular shape in substantially central part of the first plate 113 in its longitudinal direction. The connection holes 26C communicate with the two openings 20E of the second plate 122 and the one opening 20D of the second plate 123 when the plates are stacked on one another.

In addition, the first plate 113 has two connection holes 26E having a circular shape in both end portions of the first plate 113 in the longitudinal direction. The connection holes 26E communicate with the two openings 20B of the second plate 122 and the two openings 20C of the second plate 123 when the plates are stacked on one another.

A structure obtained by stacking the first plates 111, 112, 113, and 114 and the second plates 121, 122, and 123 having the above-described configurations on one another, as illustrated in FIG. 12, and brazing the plates to join them together will now be described.

In the plates joined together, the atmosphere open hole 26A, the connection holes 26B, 26C, 26D, and 26E, and the openings 20A, 20B, 20C, 20D, and 20E arranged in the plates communicate with one another, thus forming a passage that opens to the atmosphere.

Specifically, the one atmosphere open hole 26A that communicates with the atmosphere, the connection holes 26B, 26C, 26D, and 26E, and the openings 20A, 20B, 20C, 20D, and 20E are allowed to communicate with one another in a stacking direction of the plates as illustrated in FIG. 12, thus forming a connection passage. The connection passage is formed as a dividing passage that extends from the one atmosphere open hole 26A and divides into the openings 20A, 20B, 20C, 20D, and 20E so as to communicate with the openings. The connection passage extends from the one atmosphere open hole 26A and divides into two passage portions in the opening 20A to connect the openings 20A, the connection holes 26B, the openings 20E, the connection holes 26C, and the opening 20D. In addition, the connection passage connects the openings 20A, the connection holes 26D, the openings 20B, the connection holes 26E, and the openings 20C. Consequently, the openings 20A, 20B, 20C, 20D, and 20E serve as an open space that communicates with the atmosphere through the one atmosphere open hole 26A.

The atmosphere open hole 26A and the connection holes 26B, 26C, 26D, and 26E each have a smaller open area than the openings.

The formation of the openings 20A, 20B, 20C, 20D, and 20E in the second plates 121, 122, and 123 can lead to a reduction in the amount of brazing material to be applied to the second plates 121, 122, and 123. Furthermore, an excess of brazing material can be retained as fillets on inner surfaces of the openings 20A, 20B, 20C, 20D, and 20E, thus eliminating a likelihood that the excess of brazing material may enter a distribution junction passage 51*a*. This can eliminate causes of defects, such as blocking and narrowing of the passage.

In addition, the openings 20A, 20B, 20C, 20D, and 20E open to the atmosphere. Such a configuration allows an excess of brazing material entering the openings 20A, 20B, 20C, 20D, and 20E upon brazing to flow toward a relatively low pressure atmospheric space.

Consequently, a melted brazing material in the openings 20A, 20B, 20C, 20D, and 20E will not have anywhere to flow, thus preventing an excess of brazing material from entering the distribution junction passage 51*a*.

Furthermore, the above-described configuration results in a reduction in weight of the stacking-type header 51, leading to a reduction in thermal capacity. Thus, brazing time can be shortened.

Although the openings 20A, 20B, 20C, 20D, and 20E have, as examples, shapes as illustrated in FIG. 12, these openings can have any of various shapes, such as a circle, an oval, and a triangle.

Although the single atmosphere open hole 26A that communicates with the atmosphere has been described above as an example, multiple atmosphere open holes may be arranged. Furthermore, the connection passage may be formed such that the first plate 114 has an atmosphere open hole 26A.

Finally, silicone rubber is attached to the atmosphere open hole 26A communicating with the atmosphere, so that the openings 20A, 20B, 20C, 20D, and 20E serve as an enclosed space.

The single atmosphere open hole 26A communicating with the atmosphere results in a reduction of time and effort to attach silicone rubber, reducing a likelihood that water may enter the openings 20A, 20B, 20C, 20D, and 20E through the atmosphere open hole 26A. This can prevent corrosion of the plates.

In Embodiments 1 to 3, the first plates 111, 112, 113, and 114 and the second plates 121, 122, and 123, each of which is disposed between adjoining two of the first plates, that is, the seven plates in total are used as an example. The number of plates is not particularly limited. In addition, the number of divisions in the distribution junction passage is not limited to those in Embodiments 1 to 3.

The invention claimed is:

1. A stacking-type header comprising a plurality of first plates and a plurality of second plates stacked on one another, the plurality of second plates each being disposed between adjoining two of the plurality of first plates, the plurality of first plates including a first end plate being an outermost one of the plurality of first plates in a stacking direction of the plurality of first plates, the first end plate having a single first through hole, and a second end plate being an other outermost one of the plurality of first plates in the stacking direction of the plurality of first plates, the second end plate having a plurality of second through holes, the plurality of first plates and the plurality of second plates having a communication hole, the communication hole connecting the first single through hole of the first end plate and the plurality of second through holes of the second end plate, the plurality of second plates each having at least one opening formed at other than the communication hole, the at least one opening communicating with atmosphere, wherein the plurality of first plates have connection holes through which the at least one opening communicates with the atmosphere, the at least one opening comprises a plurality of openings, the plurality of openings and the connection holes communicate with one another to form a connection passage, and the connection passage is connected to one atmosphere open hole that communicates with the atmosphere.

2. The stacking-type header of claim 1, wherein the plurality of second plates each have a cut-out in part surrounding the plurality of openings such that the openings communicate with the atmosphere through the cut-out.

3. The stacking-type header of claim 1, wherein the connection holes each have a smaller open area than the plurality of openings.

4. The stacking-type header of claim 1, wherein the connection passage serves as a dividing passage that extends from the atmosphere open hole and divides into the plurality of openings.

5. The stacking-type header of claim 1, wherein the communication hole is formed by stacking one of the plurality of second plates having a first passage portion that communicates with the first through hole, one of the plurality of first plates having a first dividing passage portion that extends from the first passage portion and divides into a plurality of passage portions, another one of the plurality of second plates having a plurality of second passage portions connecting to the plurality of passage portions extending from the first dividing passage portion, another one of the plurality of first plates having second dividing passage portions each extending from the second passage portion and dividing into a plurality of passage portions, and a still other one of the plurality of second plates having a plurality of third passage portions connecting to the plurality of passage portions extending from the second dividing passage portions.

6. The stacking-type header of claim 5, wherein at least the one of the plurality of second plates having the first passage portion has an opening of the plurality of openings formed in part that does not communicate with the first dividing passage portion.

7. The stacking-type header of claim 5, wherein at least the another one of the plurality of second plates having the second passage portions has an opening of the plurality of openings formed in part that does not communicate with the second dividing passage portions.

8. The stacking-type header of claim 5, wherein at least the second plate having the third passage portions has an opening of the plurality of openings formed in part that does not communicate with the second dividing passage portions.

9. The stacking-type header of claim 1, wherein the plurality of first plates are plates with no brazing material and the plurality of second plates are plates coated with a brazing material before the plates are subjected to brazing.

10. A heat exchanger comprising:

the stacking-type header of claim 1; and a plurality of heat transfer tubes connected to the plurality of second through holes.

11. An air-conditioning apparatus comprising the heat exchanger of claim 10.

* * * * *